US010384083B2

(12) United States Patent
Bell

(10) Patent No.: US 10,384,083 B2
(45) Date of Patent: Aug. 20, 2019

(54) ROPE DESCENDERS

(71) Applicant: INTERNATIONAL SAFETY COMPONENTS LTD, Bangor, Gwynedd (GB)

(72) Inventor: Robert George Bell, Gwynedd (GB)

(73) Assignee: INTERNATIONAL SAFETY COMPONENTS LTD, Bangor, Gwynedd (GB)

( * ) Notice: Subject to any disclaimer, the term of this patent is extended or adjusted under 35 U.S.C. 154(b) by 7 days.

(21) Appl. No.: 15/034,966

(22) PCT Filed: Nov. 12, 2014

(86) PCT No.: PCT/GB2014/000462
§ 371 (c)(1),
(2) Date: May 6, 2016

(87) PCT Pub. No.: WO2015/071626
PCT Pub. Date: May 21, 2015

(65) Prior Publication Data

US 2016/0287913 A1 Oct. 6, 2016

(30) Foreign Application Priority Data

Nov. 14, 2013 (GB) ..... 1320103.3

(51) Int. Cl.
*A62B 1/14* (2006.01)
*A62B 1/20* (2006.01)

(52) U.S. Cl.
CPC . *A62B 1/14* (2013.01); *A62B 1/20* (2013.01)

(58) Field of Classification Search
CPC ..... A62B 1/14; A62B 1/20
See application file for complete search history.

(56) References Cited

U.S. PATENT DOCUMENTS 5,360,083 A * 11/1994 Hede ..... A62B 1/14 182/192
5,577,576 A * 11/1996 Petzl ..... A62B 1/14 182/193

(Continued)

FOREIGN PATENT DOCUMENTS

BR 1010840 A2 4/2016
CN 106794365 A 5/2017

(Continued)

OTHER PUBLICATIONS

Rope Rat Work Positioning Device Technical Data Sheet manual; TDS88; Issue 06; www.checkmateuk.com; accessed online on Sep. 27, 2018.

(Continued)

*Primary Examiner* — Colleen M Chavchavadze
(74) *Attorney, Agent, or Firm* — King & Schickli, PLLC

(57) ABSTRACT

A descender (1) for controlling descent of a person down a rope fixed to an anchor point, the descender comprising a rope entry guide (6) and a rope exit, an eccentrically mounted swivellable camlock (4) having a rope braking surface operable to releasably lock the rope in position against the entry guide (6) in response to movement of the rope towards the exit, and means to adjustably unlock the camlock, said unlock means including a swivellable handle (3) drivingly connected to an inner drive cam (8), the inner drive cam having bearing surfaces co-operable with the cam surfaces of an outer drive cam (11) within or on the body of the camlock (4), the arrangement being such that the reaction forces applied to the inner cam (8) via the handle (3) are transmitted to the cam surfaces of the outer cam (11) to thereby provide a mechanical advantage for causing the camlock (4) to open to thereby release the rope and thereafter allow further descent from the anchor point.

7 Claims, 11 Drawing Sheets

(56) References Cited

U.S. PATENT DOCUMENTS

Figure 1C:
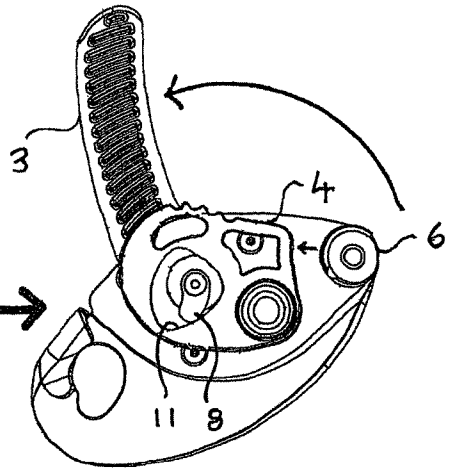

| | | | | |
|---|---|---|---|---|
| 8,100,231 | B2 * | 1/2012 | Petzl | A62B 1/14 182/5 |
| 2007/0215411 | A1 * | 9/2007 | Petzl | A62B 1/14 182/193 |
| 2009/0026023 | A1 | 1/2009 | Petzl et al. | |
| 2013/0032433 | A1 | 2/2013 | Codega | |
| 2014/0262610 | A1 * | 9/2014 | Oddou | A62B 1/14 182/5 |
| 2016/0074681 | A1 * | 3/2016 | Boraas | A62B 1/08 182/231 |
| 2016/0228730 | A1 * | 8/2016 | Chaumontet | A62B 1/14 |
| 2017/0189725 | A1 * | 7/2017 | Malcolm | A62B 1/14 |

FOREIGN PATENT DOCUMENTS

| | | | |
|---|---|---|---|
| FR | 2721523 | A1 | 12/1995 |
| FR | 2919195 | A1 | 1/2009 |
| WO | 2011028605 | A2 | 3/2011 |

OTHER PUBLICATIONS

Edelrid Eddy; manual; E-500529-000 071.3; Germany; 2013.
Dr. Gary D. Storrick; Vertical Devices; Accessed Oct. 11, 2018 http://storrick.cnc.net/VerticalDevicesPage/Rappel/StopBobbins.html.

* cited by examiner

ROPE DESCENDERS

This application is the national stage of PCT/GB2014/000462, which claims priority from Great Britain Patent Application Serial Number 1320103.3.

FIELD OF THE INVENTION

This invention relates to descenders for descending or abseiling from a height, such as a cliff face, via a rope anchored at the top end to thereafter allow a person to descend the rope in a controlled manner.

BACKGROUND OF THE INVENTION

In W02011/028605 there is shown a rope descender in which an eccentrically moveable cam has jamming surfaces co-operable to jam a rope against a convex fixed part of the descender, the cam itself being directly fixed to a handle in the form of a torque arm of length sufficient to overcome the reaction forces being applied to the rope when under load, whereby the rate of descent can be manually controlled by the person connected to the descender. Although simple to operate it will, however, be appreciated that for relatively heavy loads the rotation of the torque arm may be difficult unless the arm itself is sufficiently long enough to act as a lever for moving the jamming surface of the cam away from the rope.

Another rope descender the subject of EU'Design Registration No. 002334458-0001 dated 28 Oct. 2013 and sold as the Anthron Double Stop Descender DSD30+25 again includes a relatively long handle and its operation is described on the website www.anthron.sias having a second anti-panic jamming position when pressure on the handle is high enough such that the descent will be stopped entirely. However, it will be understood that this requires the corresponding strength of the user of the device in order for it to fulfill its stated function.

SUMMARY OF THE INVENTION

The present invention is derived from the realisation that a more compact and user-friendly approach to the problem of overcoming the force bearing on the rope by the moveable cam is needed.

According to a first aspect of the invention there is provided a descender for controlling descent of a person down a rope fixed to an anchor point, the descender comprising a rope entry guide and a rope exit, an eccentrically mounted swivellable camlock having a rope braking surface operable to releasably lock the rope in position against the entry guide in response to movement of the rope towards the exit, and means to adjustably unlock the camlock, said unlock means including a swivellable handle drivingly connected to an inner drive cam, the inner drive cam having bearing surfaces co-operable with the cam surfaces of an outer drive cam within or on the body of the camlock, the arrangement being such that the reaction forces applied to the inner cam via the handle are transmitted to the cam surfaces of the outer cam to thereby provide a mechanical advantage for causing the camlock to open to thereby release the rope and thereafter allow further descent from the anchor point.

Conveniently, the inner drive cam and outer drive cam are wholly within the major plane of the camlock so as to present a compact arrangement whereby, because of the mechanical advantage, the handle itself can be relatively short as compared to the corresponding handle or "torque arm" described in W02011/028605 and the associated jamming components of the descender.

Preferably, the descender according to the invention also includes an emergency stop function in the event that the handle is rotated too far and the user of the descender is effectively in actual or near free-fall, in which case by further rotation of the handle in the same direction an automatic locking device is triggered to close the camlock and immediately arrest the fall.

Conveniently, the emergency arrest arrangement includes a earn-actuated spring-loaded pin and associated rotatable pin capture plate which transmits torque from the handle to the camlock to make it swivel away from the rope entry guide whereafter the pin becomes disengaged from the rotatable pin capture plate allowing the latter to return the camlock to its original condition to lock or jam the rope passing therethrough and hence arrest the descent of the user of the device. This is a particularly useful feature since if a user of the descender realises that the descent is too fast it is simply necessary to continue to rotate the handle in the same direction and hence does not require any other operation.

In an alternative embodiment of emergency arrest arrangement the cam surfaces of the outer drive cam are abruptly terminated at a position corresponding to the maximum extent of swivel of the camlock away from the entry guide, corresponding to a free-fall condition, whereafter it then immediately swivels back towards the rope entry guide to stop the free-fall.

BRIEF DESCRIPTION OF THE DRAWING FIGURES

Figure 1B:
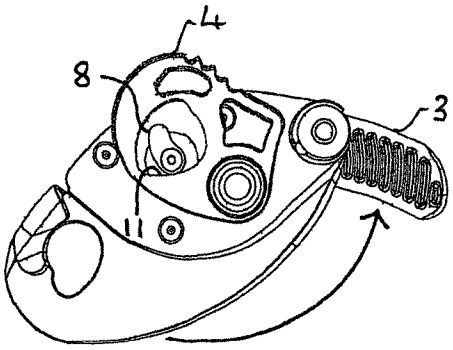
Figure 1A:
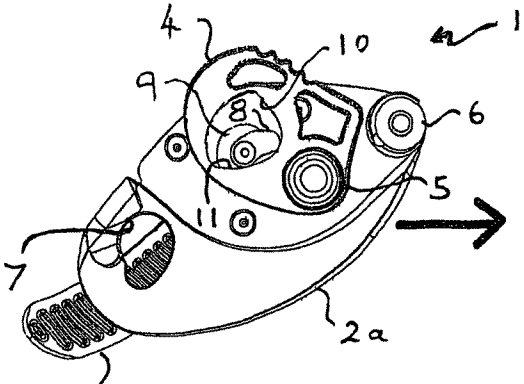
Figure 1D:
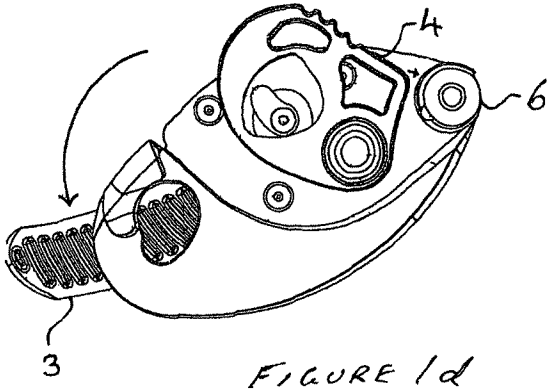
Figure 2A:
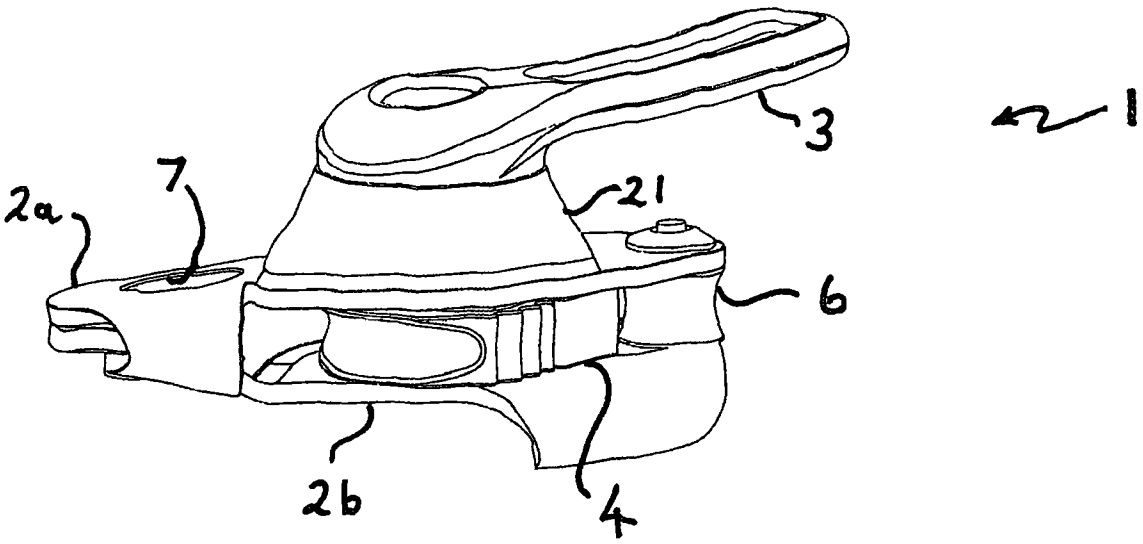
Figure 2B:
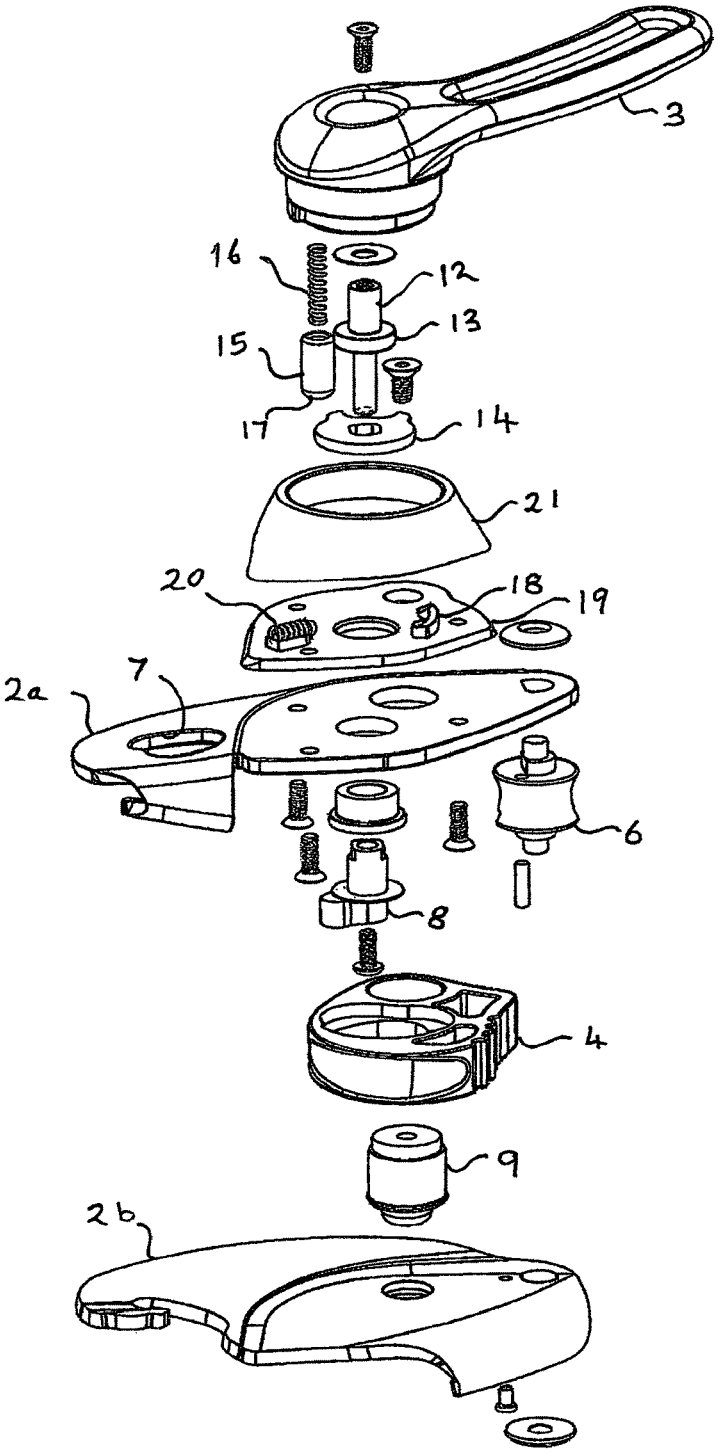
Figure 3A:
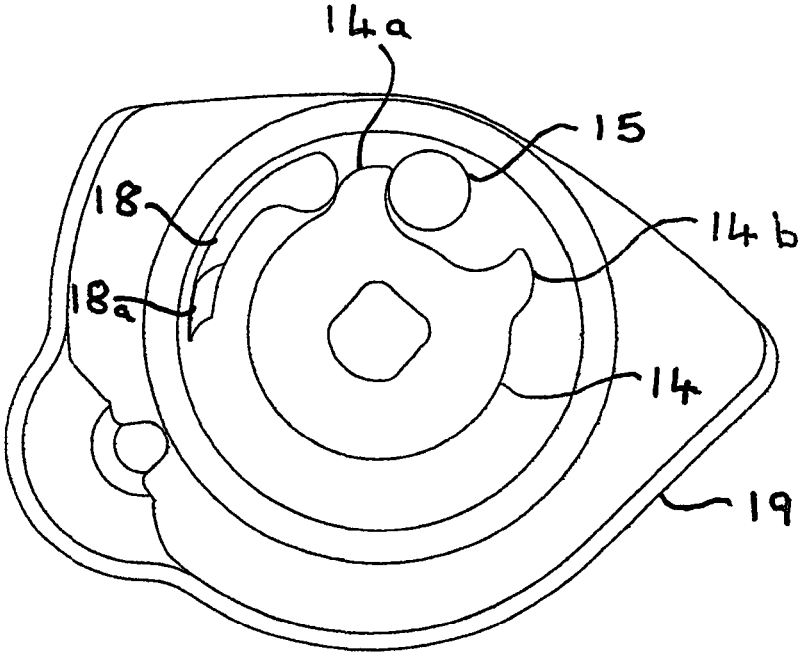
Figure 3B:
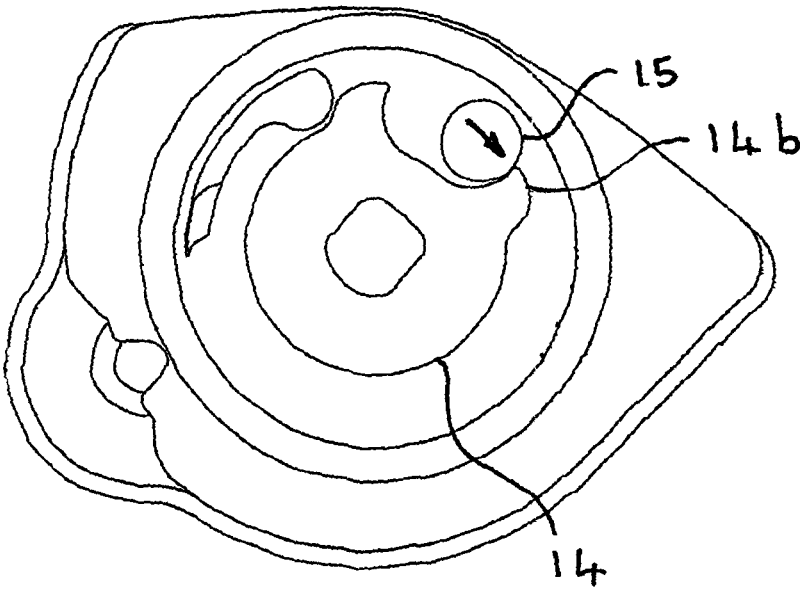
Figure 3C:
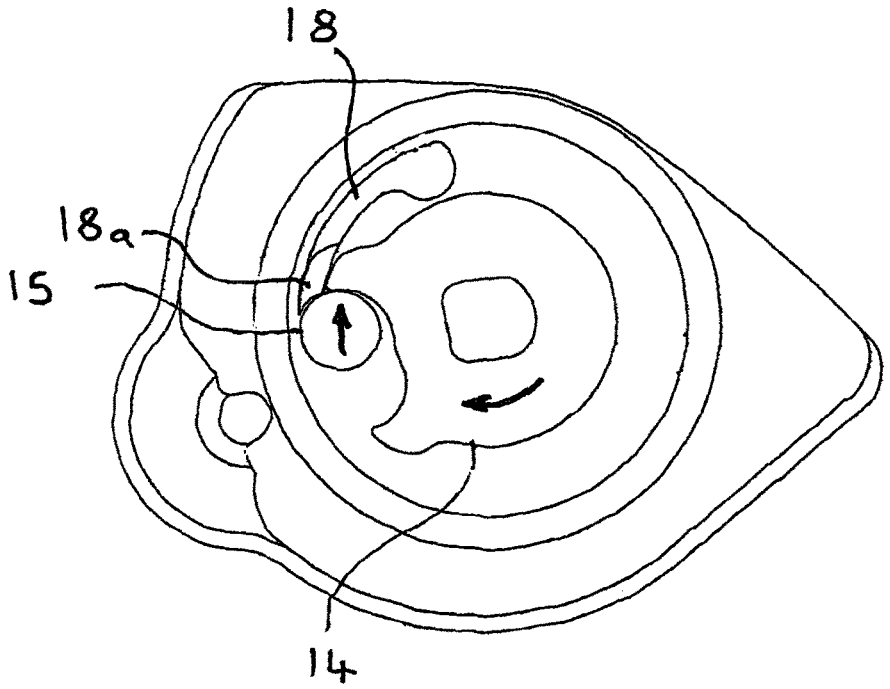
Figure 3D:
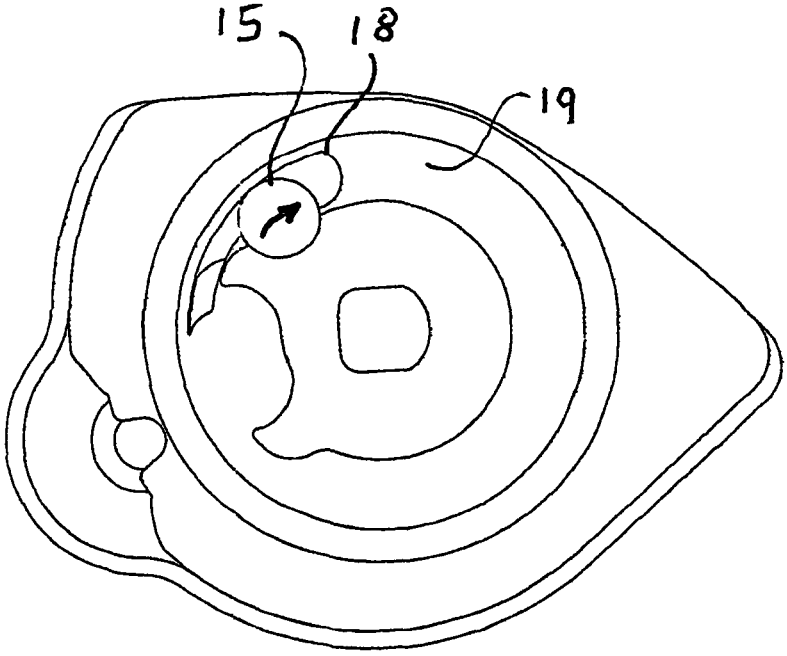
Figure 3E:
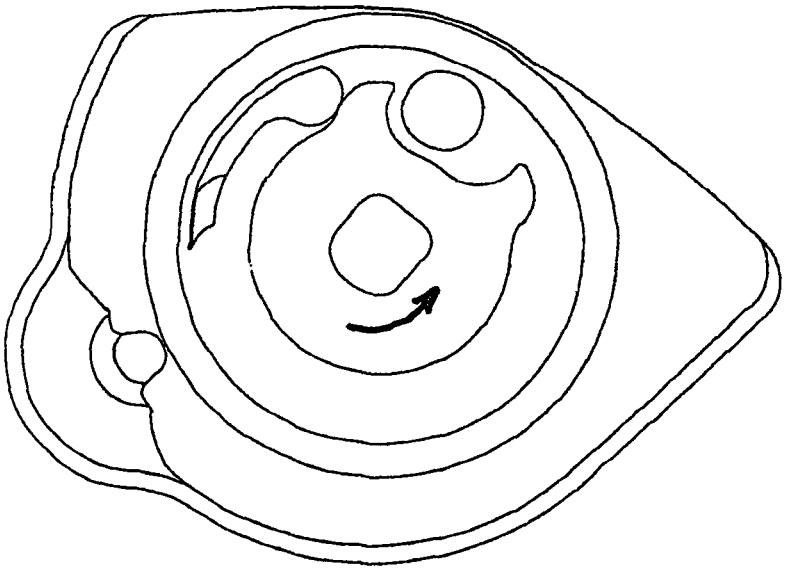
Figure 4A:
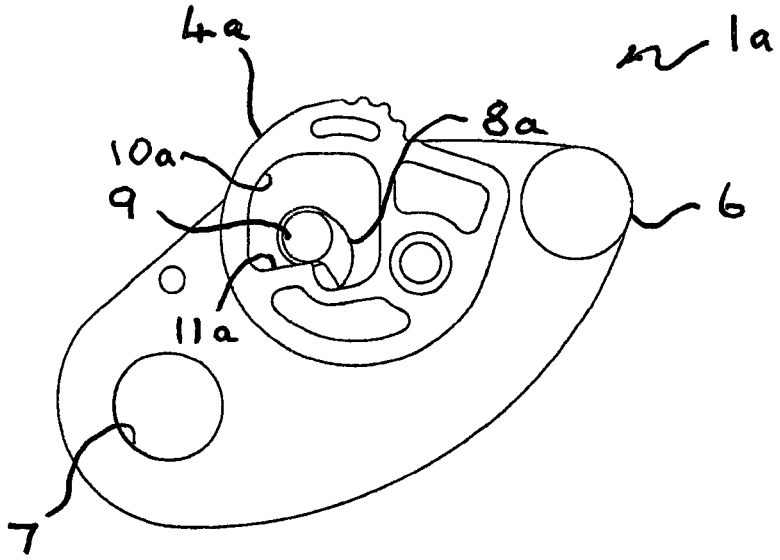
Figure 4B:
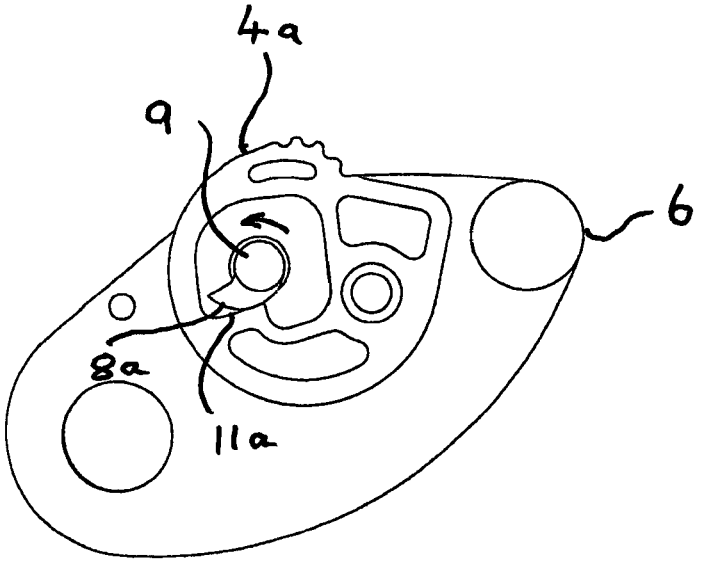
Figure 4C:
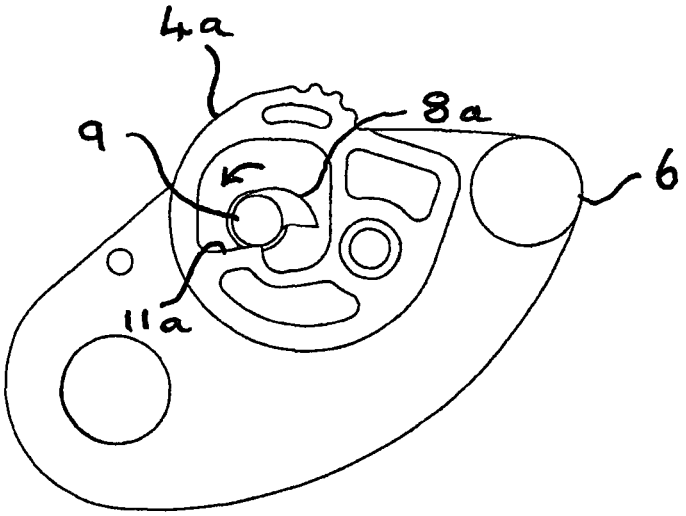

In both embodiments of emergency arrest arrangements they can also operate by simply letting go of the handle, this being a particularly advantageous feature in circumstances where e.g. the US~T of the descender is physically impaired or in panic due to an unintended free-fall condition arising The invention will now be described, by way of example only, with reference to the accompanying drawings in which:

FIGS. 1*a* to 1*d* show a schematic view of the sequences for operating the descender in its main mode, FIG. 2*a* is a perspective view of a preferred embodiment of the invention, FIG. 2*b* is an exploded view of the preferred embodiment of FIG. 2*a*, FIGS. 3*a* to 3*e* are schematic views of an emergency braking mechanism of the invention in another aspect, and FIGS. 4*a* to 4*c* are views of a variation on the emergency braking mechanism of FIGS. 3*a* to 3*e*.

DETAILED DESCRIPTION OF THE INVENTION

Turning firstly to FIG. 1*a* there is shown a part cut-out view of a descender shown generally at 1 comprising a first body half 2*a* (other half not shown), a rotatable handle 3, a swivellable camlock 4 eccentrically mounted on a pivot pin 5. The camlock 4 is moveable towards a (slack) rope entry guide 6 against which may be releasably locked or jammed a segment of rope (not shown), the rope itself exiting from the descender 1 after travelling past the pivot pin 5 and beyond an aperture 7 for receiving a carabiner (not shown) by which it may be connected to the harness of a user of the device as the user is descending.

The descender 1 also includes an inner drive earn 8 drivingly connected via a handle spindle 9 to the handle 3 within an outer drive cam aperture 10 within the camlock 4 which includes a cam surface 11 for driving the camlock 4 via the inner drive earn B.

FIG. 1*b* shows the handle 3 rotated to an intermediate position whereby the inner drive cam 8 is about to interact with the inner cam surface 11 of the outer drive cam 10 within the camlock 4. FIG. 1*c* shows a position in which the cam surfaces 8, 11 have interacted due to further rotation of the handle 3 to force the camlock 4 away from the rope entry guide 6 to thereby release the rope otherwise trapped therebetween. As will be apparent, the amount of such rope released is dependent upon the amount of swivel of the handle 3 and hence inner drive cam 8 as it increasingly bears against the cam surface 11 in the camlock 4 to force it away from the rope entry guide 6. Thus, in an elegantly simple manner the rate of descent of the descender can be easily controlled by the use of a relatively short handle 3 acting in conjunction with the cam surfaces 8, 11 which collectively provide a mechanical advantage to force the camlock 4 away from the rope.

However, in the event that too much rope has been released as a result of the handle 3 being rotated too far a further feature of the invention is shown initially with reference to FIG. 1*d* where it can be seen that further rotation of the handle 3 has caused the camlock 4 to return to the original position shown in FIG. 1*a* thereby jamming the rope against the rope anchor guide 6 to arrest any further fall of the descender 1. The mechanism for doing this is shown schematically in FIGS. 3*a* to 3*e*, such mechanism being essentially built into the housing for the handle 3 as shown with reference to the exploded view of the preferred embodiment of the invention shown with reference to FIGS. 2*a* and 2*b*.

In FIG. 2*b* the handle 3 is shown being connectable to the inner drive cam 8 via a drive pin 12 having a shoulder portion 13 for capturing a rotatable forked pin capture plate 14 and associated spring-loaded drive pin 15 received within a bore (not shown) in the handle and biased by spring 16 to move along its major axis. The free end 17 of the pin 15 is domed so that it can, in use, ride up a ramp 18 by which it can become drivingly disengaged from the pin capture plate 14 and allow the cam 8 to become temporarily drivingly disengaged from the handle 3 to thereby allow it to reassume the position shown in FIG. 1*a* in a manner to be explained with reference to FIGS. 3*a* to 3*e*.

The ramp 18 protrudes from a ramp anchor plate 19 which is also provided with a detent spring and associated detent ball mechanism 20 which, in use, releasably holds the handle 3 in its at-rest position.

Opposite the first body half 2*a* is a second body half 2*b* and overlaying the ramp anchor plate 19 is a handle cowl 21.

Turning now to FIGS. 3*a* to 3*e* which essentially show the ramp anchor base plate 19 with attendant ramp 18 and associated spring-loaded drive pin 15. In this condition the pin 15 acts to prevent the forked pin capture plate 14 from rotating about its axis within the limits of its forks 14*a*, 14*b*. As shown in FIG. 3*b*, rotation of the handle 3 allows the user of the descender to overcome the detent mechanism 20 (not shown) to allow the pin 15 to push against the fork 14*b* of the pin capture plate 14 to allow it to move clockwise along with the handle 3 to the position shown in FIG. 3*c* where the pin 15 is immediately in front of the sloped face 18*a* of the ramp 18 in a direction of motion, corresponding to the position shown with reference to FIG. 1*e*, where the cams 8, 11 co-operate to progressively force the camlock 4 away from the rope entry guide 6 to thereby progressively adjust the rate of descent. On further rotation of the handle 3 and hence the pin 15 to the point shown in FIG. 3*d* it is seen that the forked capture plate 14 is no longer captured by the pin 15, as the latter has been lifted off the upper surface of the plate 19 by means of the ramp 18, corresponding to the position shown in FIG. 1*d*, where the handle 3 has been moved to a point immediately beyond the maximum extent by which it can continue to pull the camlock 4 away from the rope entry guide 6, thereby allowing the camlock to pivot back towards it, thereby locking or jamming the portion of rope therebetween, with the mechanism being reset in the manner as shown in FIG. 3*e* by further clockwise rotation of the handle 3.

FIGS. 4*a* to 4*c* show an alternative emergency braking mechanism to that shown with reference to FIGS. 3*a* to 3*e* in which a swivellable camlock 4*a* includes an outer drive cam aperture 10*a* and associated outer drive cam bearing surface 11*a* co-operable with an inner drive earn 8*a* drivingly connected via a handle spindle 9 to a handle (not shown). In the position shown the camlock 4*a* is adjacent to the rope entry guide 6 such that, when rope is therebetween it is prevented from being pulled therethrough. This "parked" position would correspond, in use, to a user of the descender 1*a* dangling below and being supported by it and the anchored rope above it via a carabiner fixing through the aperture 7.

In FIG. 4*b* the spindle 9 is shown rotated anti-clockwise to a position in which the cam 8*a* begins to bear against the earn surface 11*a* in the camlock 4*a* to allow the speed of descent to be controlled by a user of the descender.

Depending upon the amount of rotation of the handle 3 this descent may be slow through to fast but in the event that it is too fast and the user wants to brake quickly this can be achieved by further rotation of the handle 3, or by letting the handle go, and hence assume the position shown in FIG. 4*c* in which it will be seen that the inner cam Sa has become completely disengaged from the cam surface 11*a* within the camlock 4*a* thereby allowing the latter to resume the position shown in FIG. 4*a*.

The invention claimed is:

1. A descender (1) for controlling descent of a person down a rope fixed to an anchor point, the descender comprising a rope entry guide (6) and a rope exit, an eccentrically mounted swivellable camlock (4) having a rope braking surface operable to releasably lock the rope in position against the entry guide (6) in response to movement of the rope towards the exit, and means to adjustably unlock the camlock, said unlock means including a swivellable handle (3) drivingly connected to an inner drive cam (8), the inner drive cam having bearing surfaces co operable with the cam surfaces of an outer drive cam (11) within the body of the camlock (4), the arrangement being such that the reaction forces applied to the inner cam (8) via the handle (3) are transmitted to the cam surfaces of the outer cam (11) to thereby provide a mechanical advantage for causing the camlock (4) to open to thereby release the rope and thereafter allow further descent from the anchor point.

2. A descender according to claim 1 further characterised in that the inner drive cam (8) and outer drive cam (11) are located within the body camlock (4) so as to present a compact arrangement.

3. A descender according to claim 1 further characterised in that the descender includes an emergency stop function in the event that the handle (3) is rotated too far and the user of the descender is effectively in actual or near free-fall, in which case by further rotation of the handle in the same direction an automatic locking device (14, 15, 18 or 8*a*, 10*a*, 11 *a*) is triggered to close the camlock (4) and immediately arrest the fall.

4. A descender according to claim 3 further characterised in that, the emergency stop function includes a cam-actuated spring-loaded pin (15) and associated rotatable pin capture plate (14) which transmits torque from the handle (3) to the camlock (4) to make it swivel away from the rope entry guide whereafter the pin becomes disengaged from the rotatable pin capture plate via a ramp (180) allowing the latter to return the camlock to its original condition to lock or jam the rope passing therethrough and hence arrest the descent of the user of the device.

5. A descender according to claim 3 further characterised in that the emergency stop function is provided by the cam surfaces (11*a*) of the outer drive cam being abruptly terminated at a position corresponding to the maximum extent of swivel of the camlock (4) away from the entry guide (6), corresponding to a free-fall condition, whereafter it then immediately swivels back towards the rope entry guide to stop the free-fall.

6. A descender (1) for controlling descent of a person down a rope fixed to an anchor point, the descender comprising a rope entry guide (6) and a rope exit, an eccentrically mounted swivellable camlock (4) having a rope braking surface operable to releasably lock the rope in position against the entry guide (6) in response to movement of the rope towards the exit, and a swivellable handle (3) drivingly connected to an inner drive cam (8), the inner drive cam having bearing surfaces co operable with the cam surfaces of an outer drive cam (11) within or on the body of the camlock (4), the arrangement being such that the reaction forces applied to the inner cam (8) via the handle (3) are transmitted to the cam surfaces of the outer cam (11) to thereby provide a mechanical advantage for causing the camlock (4) to open to thereby release the rope and thereafter allow further descent from the anchor point, wherein the descender includes an emergency stop function in the event that the handle (3) is rotated too far and the user of the descender is effectively in actual or near free-fall, in which case by further rotation of the handle in the same direction an automatic locking device (14, 15, 18 or 8*a*, 10*a*, 11 *a*) is triggered to close the camlock (4) and immediately arrest the fall, and wherein the emergency stop function includes a cam-actuated spring-loaded pin (15) and associated rotatable pin capture plate (14) which transmits torque from the handle (3) to the camlock (4) to make it swivel away from the rope entry guide whereafter the pin becomes disengaged from the rotatable pin capture plate via a ramp (180) allowing the latter to return the camlock to its original condition to lock or jam the rope passing therethrough and hence arrest the descent of the user of the device.

7. A descender (1) for controlling descent of a person down a rope fixed to an anchor point, the descender comprising a rope entry guide (6) and a rope exit, an eccentrically mounted swivellable camlock (4) having a rope braking surface operable to releasably lock the rope in position against the entry guide (6) in response to movement of the rope towards the exit, and means to adjustably unlock the camlock, said unlock means including a swivellable handle (3) engaging an inner drive cam (8), the inner drive cam having bearing surfaces co operable with the cam surfaces of an outer drive cam (11) within the body of the camlock (4), the arrangement being such that the reaction forces applied to the inner cam (8) via the handle (3) are transmitted to the cam surfaces of the outer cam (11) to thereby provide a mechanical advantage for causing the camlock (4) to open to thereby release the rope and thereafter allow further descent from the anchor point.

* * * * *